United States Patent [19]

Leonard

[11] Patent Number: 4,658,838

[45] Date of Patent: Apr. 21, 1987

[54] FILTER CIGARETTE HAVING ROTATABLE ADJUSTMENT

[75] Inventor: Gerard E. Leonard, Kernersville, N.C.

[73] Assignee: R. J. Reynolds Tobacco Company, Winston-Salem, N.C.

[21] Appl. No.: 808,989

[22] Filed: Dec. 16, 1985

[51] Int. Cl.[4] ..... A24D 3/04

[52] U.S. Cl. ..... 131/336; 131/338; 131/361; 131/198.2

[58] Field of Search ..... 131/198.1, 198.2, 336, 131/338, 339–341, 361

[56] References Cited

U.S. PATENT DOCUMENTS 4,526,183 7/1985 Nichols et al. ..... 131/336

4,527,573 7/1985 Hausermann ..... 131/198.2

4,532,943 8/1985 Nichols et al. ..... 131/198.2

4,570,649 2/1986 Nichols et al. ..... 131/336

*Primary Examiner*—V. Millin

*Assistant Examiner*—H. Macey

*Attorney, Agent, or Firm*—Grover M. Myers

[57] ABSTRACT

A smoking article in the form of a filter cigarette can have adjustable air dilution provided by alignment of perforations in the paper wrap of the tobacco rod, a band circumscribing the rod, and the tipping paper. The band is attached to the rod and the tipping is movable relative thereto. Perforations extending about a portion of the circumferential distance around the smoking article allow the user to adjust the setting to low or high air dilution.

4 Claims, 4 Drawing Figures

FILTER CIGARETTE HAVING ROTATABLE ADJUSTMENT

BACKGROUND OF THE INVENTION

This invention relates to smoking articles such as filter cigarettes, and in particular to such smoking articles having means for rotatable adjustment.

Cigarettes having adjustable regions have become subjects of increasing interest, particularly in situations wherein the adjustment of the air dilution value of filter cigarettes is desired. Known methods for providing adjustments to the air dilution value of filter cigarettes generally involve making one or more openings through a substantially air impermeable filter plug wrap, through the substantially air impermeable tipping paper and through a corresponding sleeve which is placed over the tipping paper, which sleeve is moveable either rotatably or axially in order to select the degree to which the sets of openings are in registry.

Numerous known methods for providing adjustments to the air dilution value of filter cigarettes suffer from various problems. For example, a movable sleeve may be easily inadvertently removed from the cigarette by the smoker and not readily replaced. Furthermore, the degree of registry between the sets of openings can be inadvertently destroyed by slight axial movement of the sleeve. Accordingly, the air dilution value, once set by the smoker, is not insured to any degree of consistency.

Recently, as disclosed in U.S. Pat. No. 4,532,943, a filter cigarette comprises a filter plug having a mouthend segment and a tobacco rod end segment, wherein the two segments are axially connected for rotation about the longitudinal axis of the cigarette. Typically, in such a filter, the two segments are defined by a circumferential cut in the filter plug. However, a cigarette having a means for adjustment which does not require a segmented filter for rotation is clearly desirable.

It would be highly desirable to provide a filter cigarette having a rotatably adjustable filter region, said filter region being easily settable and capable of having unlimited rotational ability. In addition, it would be highly desirable to provide a filter cigarette having an adjustable filter region, which cigarette is relatively easy to manufacture at a commercial scale.

SUMMARY OF INVENTION

This invention is a filter cigarette comprising in combination a rod of smokable material, an axially aligned filter plug at one end of the rod, and substantially air impermeable tipping material circumscribing and being fixedly attached to the filter plug and circumscribing a portion of the rod in the region adjacent the filter plug. The cigarette further comprises first and second bands in an end-to-end relationship. The bands circumscribe the rod in the region adjacent the filter plug, and are disposed in and substantially fill the transverse region between the outer surface of the rod and the inner surface of the tipping material. The first band is constructed from a substantially air impermeable material and is fixedly attached to the rod in the region adjacent the filter plug. The first band comprises a substantially air impermeable region extending circumferentially about a portion of the circumferential distance around the rod. The first band and the underlying portion of the rod comprises an air permeable region extending circumferentially about a portion of the circumferential distance around the rod. The second band is positioned adjacent the first band towards the fire end (i.e., the end which is lit) of the cigarette and the outer surface thereof is fixedly attached to the inner surface of the tipping material which overlies that second band. The tipping material comprises an air permeable region in the region therein which overlies the air permeable region of the first band. As the filter end of the cigarette is axially rotated relative to the rod, the degree of radial alignment between the air permeable region of the tipping material and the air permeable region of the first band is varied.

The present invention provides an efficient and effective means for manufacturing filter cigarettes having adjustable air delivery capabilities. In particular, filter cigarettes having adjustable air delivery capabilities can be manufactured in a low air dilution/high delivery setting while employing conventional cigarettes manufacturing equipment.

The user of this invention can easily rotate the filter end of the cigarette about the longitudinal axis of the cigarette and relative to the rod in order to vary the degree of radial alignment between the air permeable region of the tipping material and the air permeable region of the first band and hence vary the air dilution capabilities of the cigarette. The degree of radial alignment can vary continuously from a position of substantially disalignment wherein the combination of tipping material and underlying first band function to provide a substantially air impermeable region with respect to air dilution; to a position of substantially complete alignment wherein the combination of tipping material and underlying first band function to provide maximum air dilution capabilities to the cigarette.

DETAILED DESCRIPTION OF THE EMBODIMENTS

Figure 1:
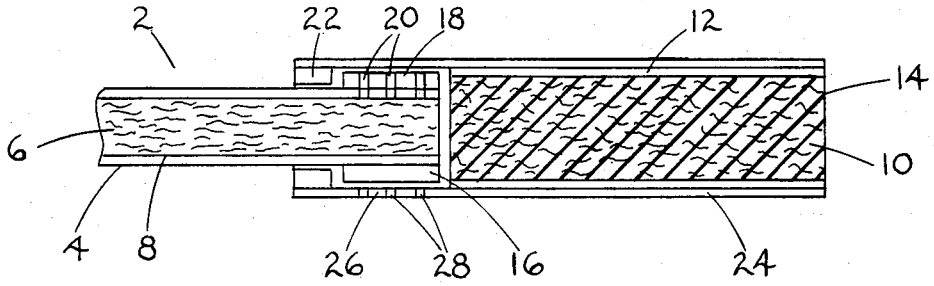
FIG. 1 is a diagrammatic cross sectional illustration of a portion of a cigarette showing the filter portion thereof, wherein the cigarette is positioned in the low or non-air dilution setting according to an embodiment of this invention.
Figure 2:
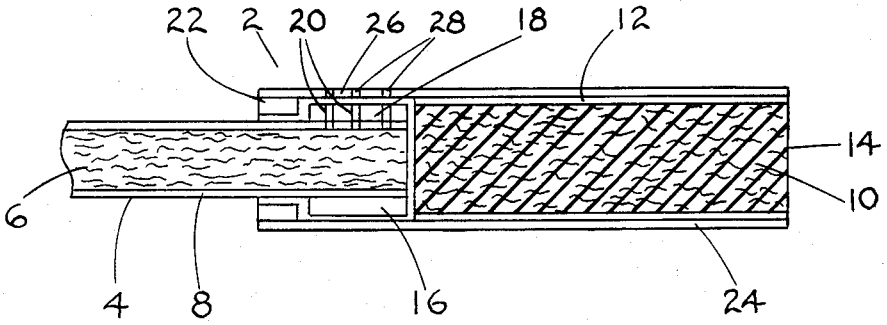
FIG. 2 is a diagrammatic cross sectional illustration of a portion of a cigarette showing the filter portion thereof, wherein the cigarette is positioned in the high air dilution setting according to an embodiment of this invention.

An embodiment of this invention shown in FIGS. 1 and 2 is a smoking article 2 in the form of a filter cigarette. The smoking article comprises a generally cylindrical rod 4 of smokable material 6 contained in wrapping material 8. Typically, the smokable material is a charge of shredded or cut tobacco, reconstituted tobacco, tobacco substitute, or blends thereof; and the wrapping material is a conventional substantially air impermeable cigarette wrapping paper. Rod 4 is axially aligned in a substantially abutting end-to-end relation with generally cylindrical filter plug 10. The filter plug can be constructed from any conventional filter material such as air permeable cellulose acetate; and the ends of the filter plug along the longitudinal axis of the cigarette are open to permit the passage of air and smoke. Filter plug 10 is preferably overwrapped with circumscribing plug wrap 12 in order to form wrapped plug 14. Typically, plug wrap 12 is a conventional, substantially air impermeable plug wrap material such as paper the inner surface of which is adhesively secured to the outer surface of the filter plug.

First band 16 circumscribes rod 4 at the end thereof adjacent the filter plug and the inner surface of the first band is fixedly attached to the outer surface of the rod using an adhesive material. First band 16 is provided from a substantially air impermeable material and is typically provided from air impermeable paper such as air impermeable tipping paper. The length which first band 16 extends longitudinally along rod 4 depends upon factors such as the air dilution capabilities required, and the amount of retention capabilities required in order to maintain connection of the rod to the filter plug. Typically, first band 16 can extend about 4 mm to about 6 mm longitudinally along the rod. In the preferred embodiment, the diameter of wrapped filter plug 14 (defined by filter plug 10 and circumscribing plug wrap 12) essentially equals that diameter of rod 4 circumscribed by said first band 16.

First band 16 and underlying wrapping material 8 have an air permeability region 18 therein (hereinafter referred to as region 18). Region 18 can be provided by an opening in the form of holes 20 in each of the first band and the underlying wrapping material. The air permeability region or air dilution region can be provided by a series of holes, perforations or slits which extend circumferentially about the smoking article which allow air dilution of the smoke which passes through the smoking article upon use. The amount of air dilution provided is a matter of choice. As used herein, "air dilution" refers to the ratio of the volume of air drawn through air dilution openings to the volume of air and smoke drawn through the cigarette and exiting the extreme mouthend portion of the cigarette. Typically, region 18 extends circumferentially about the longitudinal axis of the smoking article in an amount of up to about 50 percent of the circumference of the smoking article. Region 18 extends along the longitudinal axis of the smoking article in an amount which can vary and is generally dependent upon the width of first band 16. Typically, it is desirable that region 18 extend a minimal distance longitudinally along the smoking article. For example, one row of perforations or one slit can extend in a substantially linear fashion circumferentially about a portion of the periphery of the smoking article.

Second band 22 circumscribes rod 4 adjacent to first band 16 and towards the fire end of rod 4 relative to the first band. In the preferred embodiment, second band 22 is not fixedly attached to rod 4 and is circumferentially rotatable about the longitudinal axis of rod 4. Second band 22 can be provided from a variety of materials and is typically provided from paper such as tipping paper, or the like. The length which the second band extends longitudinally along rod 4 can vary, and is typically great enough to provide sufficient retention of the rod to the filter plug. Typically, second band 22 can extend about 3 mm to about 5 mm longitudinally along the rod.

Tipping material 24 circumscribes (i.e., envelopes) the wrapped plug, the first band and the second band. The inner surface of tipping material 24 is fixedly adhered to the outer surface of wrapped plug 14 and to the outer surface of second band 22. Typically, the second band is fixedly adhered to the tipping material such that the first and second bands substantially abut one another. Tipping material 24 is a substantially air impermeable material such as tipping paper. Tipping material 24 extends longitudinally along the smoking article in an amount which can vary. Typically, tipping material 24 extends along the wrapped plug from the extreme mouthend portion of the smoking article and along adjacent region of rod 4. The length which tipping material 24 extends along the rod depends upon factors such as the length of first band 16, second band 22 and the longitudinal distance between each of the aforementioned bands.

Tipping material 24 contains an air permeability region 26 (hereinafter referred to as region 26). Region 26 can extend circumferentially about a portion of the periphery of tipping material 24 in an amount which can vary. Typically, region 26 extends circumferentially about the longitudinal axis of the smoking article in an amount of up to about 50 percent of the circumference of the smoking article. Region 26 can extend longitudinally along tipping material 24 in an amount which is essentially dependent upon the distance that first band 16 extends along tobacco rod 4. For example, in order that a cigarette exhibiting low or non air dilution can be achieved, it is desirable that region 26 not extend as great a distance longitudinally along tipping material 24 than that distance which first band 16 extends along rod 4. Air permeable region 26 can be provided by a variety of means. For example, substantially air impermeable tipping paper can be cut or perforated in order to provide slits or holes, preferably which extend circumferentially about a portion of the cigarette. As illustrated in FIGS. 1 and 2, tipping material 24 can contain a series of holes 28 at region 26.

Wrapped plug 14 is rotatable along the longitudinal axis of the cigarette relative to rod 4. The wrapped plug is retained to the rod as first band 16 and second band 22 provide a means for retaining the wrapped filter plug 14 to rod 4. In particular, the abutment of second band 22 against first band 16 provides an effective means for preventing the wrapped plug 14 from being pulled away from and out of contact from the rod.

FIG. 1 illustrates a cigarette positioned in a low or non air dilution setting whereby region 26 is prevented from providing effective air dilution due to the positioning of the regions of air permeability of each of tipping material 24 and first band 16 which is attached to rod 4. In particular, the substantially air impermeable tipping material overlies the air dilution openings of the first band and thereby providing an effective barrier to air dilution of the cigarette (i.e., the air permeable region of first band is in radial alignment with the substantially air impermeable tipping material).

FIG. 2 illustrates a cigarette positioned in a high air dilution setting. Wrapped plug 14 is circumferentially rotated relative to rod 4 such that the region of air permeability of the tipping material provides for effective air dilution due to the fact that air permeable region 26 of the tipping material overlies an air permeable region 18 of first band 16 and underlying wrapping material 8 (i.e., the air permeable region of the first band and the underlying wrapping material is in radial alignment with the air permeable region of the tipping material). The amount of air dilution can be varied by varying the amount by which region 26 of tipping material 24 overlies region 18; or by varying the degree by which the openings of each of region 26 and region 18 are in registry; or other such factors.

Figure 3:
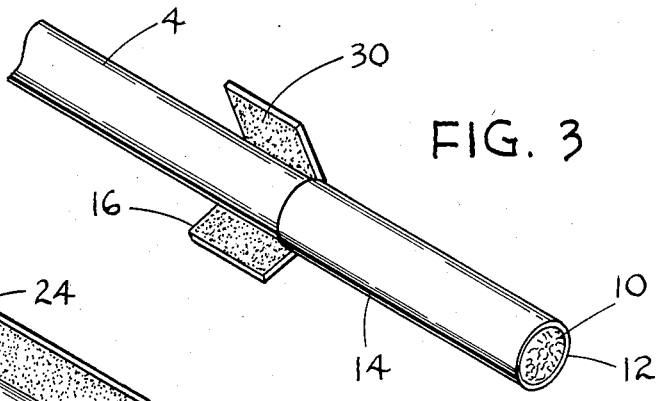
FIG. 3 is a partially fragmentary perspective taken from the mouthend of a partially assembled embodiment of this invention.
Figure 4:
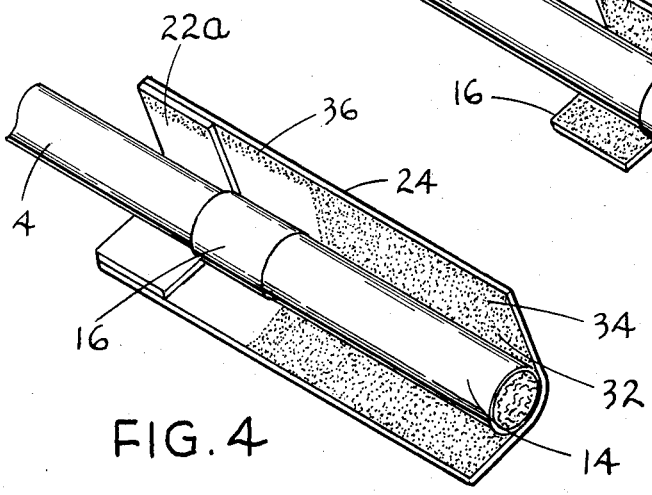
FIG. 4 is a partially fragmentary perspective taken from the mouthend of a partially assembled embodiment of this invention.

A process for providing the filter cigarettes of this invention is diagrammatically illustrated in FIGS. 3 and 4. In FIG. 3, rod 4 is circumscribed by first band 16 which is attached to rod 4 using adhesive material 30 which is applied to the inner surface of the first band. The rod also is axially aligned with wrapped plug 14 (defined by filter plug 10 and plug wrap material 12). In FIG. 4, a portion of the assembly illustrated in FIG. 3 is circumscribed by tipping material 24 which overlies wrapped plug 14 and first band 16. Preferably, the second band is provided by attaching (i.e., with an adhesive material) a strip of wrap material 22*a* to the inner surface of the rod end region of tipping material 24. Adhesive material 32 is applied to region 34 of tipping material 24, which overlies wrapped plug 14. Adhesive 36 is applied to the outer lap zone along the inner longitudinal edge of tipping material 24 such that the tipping material effectively circumscribes the desired portion of the cigarette assembly. Thus, the first and second bands are disposed (i.e., located) in and substantially fill the transverse region between the outer surface of the rod and the inner surface of the tipping material. The air dilution region (not shown) can be provided by perforating the tipping material, underlying first band, and underlying wrapping material.

If desired, markings (e.g., with ink) can be printed on the tipping material and the exposed portion of the wrapping material of the rod in order to provide a visual indication of the amount of air dilution which is selected.

It is understood that the particular embodiments described above are only illustrative of the principles of this invention, and that various modifications can be made by those skilled in the art without departing from the scope and spirit of the invention.

What is claimed is:

1. A filter cigarette comprising in combination a rod of smokable material, an axially aligned filter plug adjacent one end of the rod, and substantially air impermeable tipping material circumscribing and being fixedly attached to the filter plug and circumscribing a portion of the rod in the region adjacent the filter plug;

said cigarette further comprising first and second bands in an end-to-end relationship, said bands circumscribing the rod in the region adjacent the filter plug and being disposed in and substantially filling the transverse region between the outer surface of the rod and the inner surface of the tipping material;

the first band being constructed from a substantially air impermeable material and is fixedly attached to the rod in the region adjacent the filter plug;

said first band comprising a substantially air impermeable region extending circumferentially about a portion of the circumferential distance around the rod, and said first band and underlying portion of the rod comprising an air permeable region extending circumferentially about a portion of the circumferential distance around the rod;

the second band being positioned adjacent the first band towards the fire end of the cigarette and the outer surface thereof is fixedly attached to the inner surface of the tipping material which overlies said band;

the tipping material comprising an air permeable region in the region therein which overlies the air permeable region of the first band;

wherein axial rotation of the filter end of the cigarette relative to the rod varies the degree of radial alignment between the air permeable region of the tipping material and the air permeable region of the first band.

2. The filter cigarette of claim 1 wherein the material of said first band, said second band and said tipping material is paper, and the regions of air permeability is provided by a series of perforations therein.

3. The filter cigarette of claim 2 wherein said rod of smokable material comprises a smokable material contained in a wrapping material, wherein said wrapping material is paper having a region of air permeability in the region therein which underlies the perforations in the first band and tipping material.

4. The filter cigarette of claim 1 wherein each of said first and second bands are in a substantially abutting end-to-end relationship.

* * * * *